United States Patent [19]

Tai-Her

[11] 4,295,130

[45] Oct. 13, 1981

[54] AUDIO-VISUAL DISASTER ALERT SYSTEM

[76] Inventor: Yang Tai-Her, No. 9-1, Tai-Ping St., Kung-Hua Li, Hsi-Hu Town, Chang Hua Hsien, Taiwan

[21] Appl. No.: 49,806

[22] Filed: Jun. 18, 1979

[51] Int. Cl.[3] ..... G08B 19/00

[52] U.S. Cl. ..... 340/524; 340/517; 340/525; 179/5 P

[58] Field of Search ..... 340/517, 521, 524, 525, 340/500; 179/5 R, 5 P, 100 PS, 100.11, 100.12 R, 100.41 T

[56] References Cited

U.S. PATENT DOCUMENTS 3,207,849 9/1965 Andrews ..... 179/5 P 4,107,464 8/1978 Lynch et al. ..... 179/5 P

*Primary Examiner*—Alvin H. Waring

*Attorney, Agent, or Firm*—Blair, Brown & Kreten

[57] ABSTRACT

A disaster alert system for a public area, building or the like, each area of which is provided with a sensor responsive to a localized disaster such as a fire with a circuit for each sensor connected to an audio/visual device identified with a specific area, the circuits being connected together so that the response of a sensor in a specific area activates the associated audio/visual device to provide an alerting output which indicates the location of the disaster and measure to be taken at all of the interconnected audio/visual devices.

7 Claims, 3 Drawing Figures

AUDIO-VISUAL DISASTER ALERT SYSTEM

BACKGROUND OF THE INVENTION

Current disaster alarms in buildings give only a warning alarm or buzzer without indicating the location of the disaster and proper measures to be taken in case these is a disaster in the building. Therefore, there is often confusion which may cause other damage. In view of such a defect, the inventor created the audio/-visual disaster alert system.

SUMMARY OF THE INVENTION

The invention is a device to be installed on every floor of a building and gives an audio/visual alert by means of a tape recording. There are three forms of structure:

(1) A disaster sensor and an audio-visual tape recorder/player are provided at an appropriate place on each floor of a building and the recorder is recorded with the information concerning measures to be taken at that area when there is a disaster in some certain area. When a disaster occurs, the tape recorder/player is started by sensing through the sensor. Then, the location of the disaster and the necessary measures to be taken are displayed on an audio/visual display.

(2) A sensor and an audio/visual display are provided at an appropriate area on each floor of a building and there is a central control device for the whole building. Such a device comprises a tape recorder/player which is started when a signal from the sensor indicates the occurrence of a disaster.

(3) An additional display is included in the structure as described above either integrally or separately at an appropriate area on each floor in order to display the location of the disaster.

DESCRIPTION OF THE PREFERRED EMBODIMENT

Figure 1:
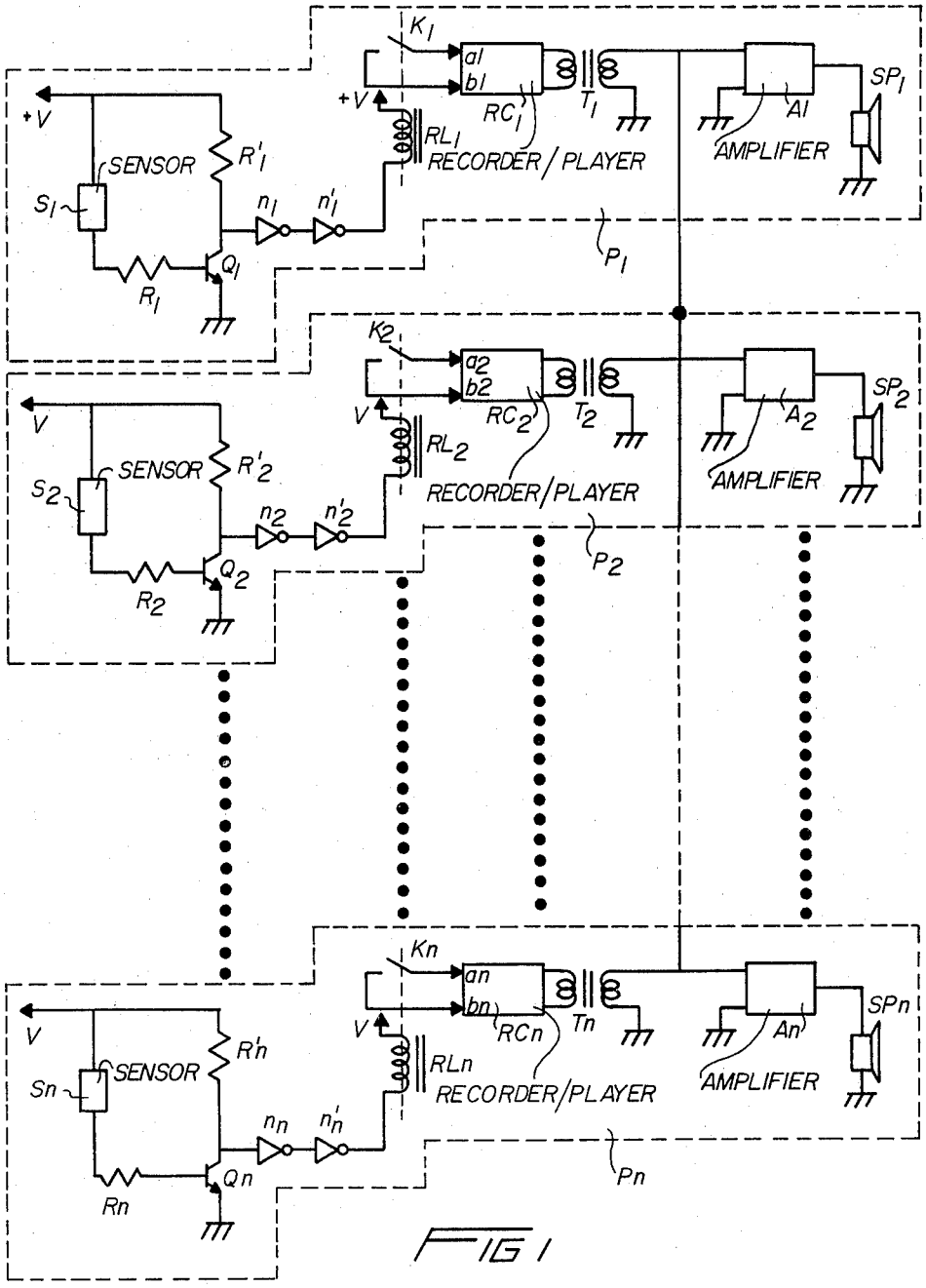
FIG. 1: An embodiment of the control circuit for the invention.

FIG. 1 shows the first embodiment of the invention, wherein $P_i$(i=1,2 . . . n) is a system which is provided on the ith floor of a building or area i of some other construction and $S_i$ is a sensor which senses a disaster. With fire as an example, when there is a fire, $S_i$ is closed and then $Q_i$ is turned on by the saturation of collector current in $Q_i$, $Q_i$ drives an output Low. Then, relay $RL_i$ functions and $K_i$ is closed; $RC_i$ is a recorder/player. When $K_i$ is closed, the internal circuit is closed, and then the recorder is started so that there is a tone signal input of transformer $T_i$. After amplification by amplifier $A_1$, $A_2$ . . . $A_n$ on each floor, speaker $SP_1$, $SP_2$ . . . $SP_n$ on each floor starts an announcement. Since the contents of the tape in each recorder player $RC_i$(i=1,2, . . . n) is different from each other, each floor will be provided with an announcement as to the location of the disaster together with the respect measures to be taken.

Figure 2:
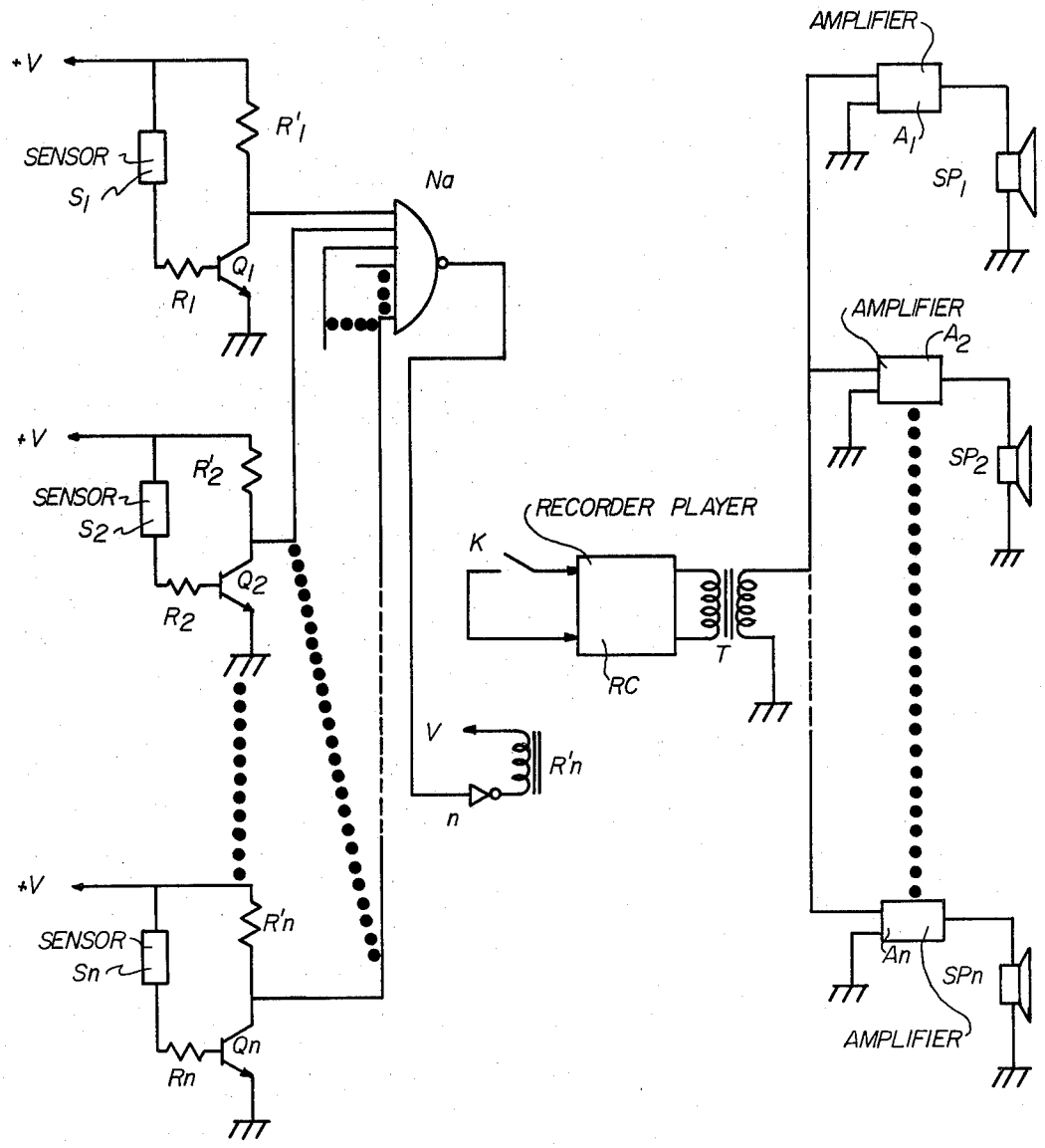
FIG. 2: Another embodiment of the control circuit of the invention.

FIG. 2 shows the second embodiment of the invention, wherein $S_i$(i=1,2, . . . n) is a sensor provided at an appropriate area on a floor and $Q_i$ is a transistor under its control. Once there is a disaster, the collector voltage of the corresponding transistor $Q_i$(i=1,2, . . . n) will be lowered to a Low from HIgh. Therefore, the output of NAND gat Na will be raised to a RL function and K will be closed instead of open. While K is closed, tape of recorded RC is started and the pre-recorded tone ti released. After amplification by transformer T and amplifier $A_1$, $A_2$ . . . $A_n$, the speakers $SP_1$, $SP_2$ . . . $SP_n$ will announce an alert.

Figure 3:
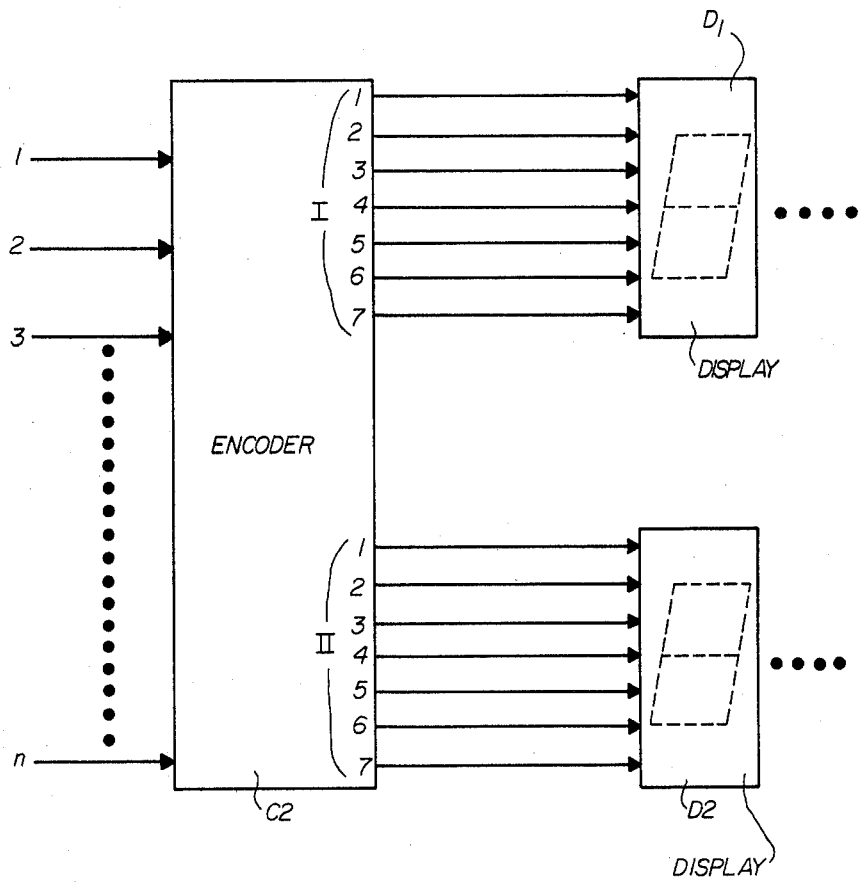
FIG. 3: A control circuit of the display hereof, which forms the third embodiment of the invention together with that shown in FIG. 2.

FIG. 3, in connection with FIG. 2, forms the third embodiment of the invention, wherein (1), (2), . . . (n) are input terminals from the collectors of transistors $Q_1$, $Q_2$ . . . $Q_n$ in FIG. 2 respectively. CN is an encoder with fourteen output terminals in two groups. Each group of outputs will form an input to the display $D_1$, $D_2$. If $D_1$, $D_2$, . . . are sequentially connected, and provided at an appropriate area on different floors then, once there is a disaster at a certain area, the display $D_1$ $D_2$ will indicate the location of the disaster.

What is claimed is:

1. An audio/visual disaster alert system for a plurality of areas in a building or the like comprising, in combination, a disaster warning circuit in each of said areas, an associated source of electric power, each of said disaster warning circuits including sensing means responsive to a disaster for producing an out signal a normally inoperative tape recorder/player having an audio output for providing a taped message stating the location of the disaster and the disaster measures to be taken and a speaker connected to said tape recorder/player audio output, means responsive to said output signal from said sensing means in each of said areas for activating the associated tape recorder/player to provide an audio output, means for feeding the audio output of said activated tape recorder/player to the associated speaker in said area and means for interconnecting the audio output from said activated tape recorder/player to all of the speakers in said areas, whereby the message from said activated tape recorder/player is supplied to the speakers in all of said disaster warning circuits.

2. An audio/visual disaster alert system in accordance with claim 1 including digital display means and means for connecting said sensing means to said digital display means to provide a visual display of the location of said disaster.

3. An audio/visual disaster alert system in accordance with claim 2 wherein said means for connecting said sensing means to said digital display means includes an encoder.

4. An audio/visual disaster alert system in accordance with claim 1 wherein said associated source of power comprises an emergency power source for the system which insures function of the system during occurrence of the disaster.

5. An audio/visual disaster alert system in accordance with claim 1 wherein said output signal responsive means includes a relay having a coil and a normally open switch for connecting said tape recorder/player to said associated source of power, and means for conducting said output signals from said sensing means to said relay coil for energizing said coil to close said switch and connect said tape recorder/player to said associated source of power.

6. An audio/visual disaster alert system in accordance with claim 5 wherein said sensing means includes a sensor, a transistor connected to said associated source of power and having a base connected to said sensor and wherein said means for conducting said output signal from said sensing means to said relay coil include at least one inverter connected between said relay coil and the collector of said transistor.

7. An audio/visual disaster alert system in accordance with claim 6 including a NAND gate connected between said at least one inverter and said transistor collector.

* * * * *